US006796626B2

(12) United States Patent
Nishida

(10) Patent No.: US 6,796,626 B2
(45) Date of Patent: Sep. 28, 2004

(54) IMAGE PRINTING APPARATUS

(75) Inventor: Hideyuki Nishida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/352,955

(22) Filed: Jan. 29, 2003

(65) Prior Publication Data

US 2003/0142164 A1 Jul. 31, 2003

(30) Foreign Application Priority Data

Jan. 31, 2002 (JP) ..... 2002-024106

(51) Int. Cl.[7] ..... B41J 29/38
(52) U.S. Cl. ..... 347/5
(58) Field of Search ..... 347/5, 9, 37

(56) References Cited

U.S. PATENT DOCUMENTS

| | | | | |
|---|---|---|---|---|
| 4,313,124 | A | 1/1982 | Hara | 347/57 |
| 4,345,262 | A | 8/1982 | Shirato et al. | 347/10 |
| 4,459,600 | A | 7/1984 | Sato et al. | 347/47 |
| 4,463,359 | A | 7/1984 | Ayata et al. | 347/56 |
| 4,558,333 | A | 12/1985 | Sugitani et al. | 347/65 |
| 4,608,577 | A | 8/1986 | Hori | 347/66 |
| 4,723,129 | A | 2/1988 | Endo et al. | 347/56 |
| 4,740,796 | A | 4/1988 | Endo et al. | 347/56 |
| 2002/0145639 | A1 | 10/2002 | Masuda et al. | 347/14 |
| 2002/0171695 | A1 | 11/2002 | Masuda | 347/9 |
| 2003/0141857 | A1 * | 7/2003 | Nishida et al. | 323/282 |

FOREIGN PATENT DOCUMENTS

| | | |
|---|---|---|
| GB | 2 311 494 | 10/1997 |
| JP | 54-56847 | 5/1979 |
| JP | 59-123670 | 7/1984 |
| JP | 59-138461 | 8/1984 |
| JP | 60-71260 | 4/1985 |
| JP | 5-64425 | 3/1993 |
| JP | 5-292742 | 11/1993 |
| JP | 6-201738 | 7/1994 |
| JP | 10-6505 | 1/1998 |

* cited by examiner

*Primary Examiner*—Lamson Nguyen
*Assistant Examiner*—Blaise Mouttet
(74) *Attorney, Agent, or Firm*—Fitzpatrick, Cella, Harper & Scinto

(57) ABSTRACT

In order to realize stable image printing, this invention provides an image printing apparatus capable of supplying a stable voltage to a printhead, and maintaining a compact shape. For this purpose, in the image printing apparatus in which a carriage which supports a printhead is scanned on a printing medium to print an image, a power converter which converts power to be supplied to the printhead is mounted on the first print circuit board of the carriage so as to supply a predetermined voltage to the printhead. The printhead and a power smoothing unit which smoothes the voltage converted by the power converter in accordance with the load of the printhead are mounted on the second print circuit board. The first and second print circuit boards are separately arranged at a proper gap in the image printing apparatus, which prevents an increase in the size of the image printing apparatus.

11 Claims, 14 Drawing Sheets

IMAGE PRINTING APPARATUS

FIELD OF THE INVENTION

The present invention relates to an image printing apparatus using a printhead and, more particularly, to an image printing apparatus capable of supplying a stable power to the printhead and printing a high-quality image.

BACKGROUND OF THE INVENTION

Printers which print desired information such as characters or images on a sheet-like printing medium such as a paper sheet or film are adopted as an information output apparatus for a word processor, personal computer, facsimile machine, or the like.

The printing method of the printer includes various methods. An ink-jet method has recently received a great deal of attention because it can perform non-contact printing on a printing medium such as a paper sheet, can easily print a full-color image, and is quiet. As an ink-jet arrangement, a serial printing method is generally widely used in terms of low cost and easy downsizing. In the serial printing method, a printhead for discharging ink in accordance with desired printing information is mounted. Information is printed by reciprocally scanning the printhead in a direction perpendicular to the feed direction of a printing medium such as a paper sheet.

FIG. 6 is a block diagram showing a supply system which supplies power and an image signal from a conventional ink-jet printer main body to the printhead. FIG. 7 is a side view showing a carriage electric mounting portion mounted on the carriage of the conventional printer.

In the conventional ink-jet printer, a power supply for supplying power is incorporated as a power supply unit board 103 in the printer main body, as shown in FIG. 6, or is connected as an AC adapter (not shown) to the printer main body. Necessary power is supplied to a printhead 102 connected to a carriage board A 100 mounted on the carriage via a power supply wiring pattern 105 on a main body board 104 and via a flexible wiring conductor (flexible wiring board or wiring line called "flat cable") 101.

Recent printers are required to achieve high quality equivalent to a photograph (to be referred to as photographic quality hereinafter) and performance of printing an image at a high speed (to be referred to as high-speed printing hereinafter). The ink-jet printer technique has remarkably been developed, and the above-described conventional power supply method poses the following problems.

More specifically, to meet both the photographic quality and high-speed printing, it is necessary that "small ink droplets are discharged from the printing elements of the printhead 102 to a printing medium (e.g., printing sheet) as much as possible per unit time". The ink-jet printer must satisfy this demand. For this purpose, the electric energy (power) per unit time necessary for printing to be supplied to the printhead 102 must be increased.

The power supply for supplying power is generally a constant-voltage power supply. To meet both the photographic quality and high-speed printing, a current ($I_{Prhd}$) supplied to the printhead 102 as a load is increased by the load.

The above-mentioned flexible wiring conductor 101 generates the following voltage drop ($V_{Drop}$) owing to its wiring resistance ($R_{Frex}$):

$$V_{Drop}=I_{Prhd}\times R_{Frex}$$

The voltage drop $V_{Drop}$) changes depending on an image to be printed by the printhead 102. With an excessively large voltage drop $V_{Drop}$), a voltage supplied from the power supply for supplying power becomes lower than a voltage necessary for the printhead 102 to print an image. As a result, ink necessary to print an image may not be able to be supplied from the printing element.

To solve this problem, the voltage drop ($V_{Drop}$) by the wiring resistance ($R_{Frex}$) is suppressed to be small. In order to reduce the wiring resistance ($R_{Frex}$) of the flexible wiring conductor 101, the power supply line has been made thick or the number of power supply lines has been increased.

In these measures, the flexible wiring conductor 101 functions as a physical load to the carriage, and causes various problems: (1) the load of the carriage driving motor increases; (2) the rigidity of the power supply line increases to impair the flexibility of the wiring conductor 101; and (3) the cost of the wiring conductor 101 increases.

Especially in a large A0-size ink-jet printer, the flexible wiring conductor 101 is longer than that of an A4-size home printer, and exceeds 1 m including internal wiring. Thus, the above-described problems become serious, and electric energy (power) necessary for printing to be supplied to the printhead 102 cannot be satisfactorily supplied.

As one solution for the problem, an example of mounting a power supply for supplying power on the carriage is disclosed in Japanese Patent Laid-Open No. 10-6505 (Hewlett-Packard) "Carriage-Mounted Printed Circuit Assembly to Which Pen Driver and Power Supply Circuit Are Assembled".

When, however, the arrangement disclosed in Japanese Patent Laid-Open No. 10-6505 was applied to an actual ink-jet printer, the following problems 1 and 2 occurred, and it was found that the ink-jet printer could not be easily constituted.

[Problem 1]

No mounting space can be ensured on a carriage board A 110 due to restrictions on the printing direction.

FIG. 8 is a block diagram showing the power supply system of an ink-jet printer when a power supply (DC/DC converter) for supplying power is mounted on the carriage board A 110. FIG. 9 is a side view showing a carriage electric mounting portion when the power supply for supplying power is mounted on the carriage board A 110.

In printing an image, as shown in FIG. 7, a conventional ink-jet printer discharges ink droplets from the lower surface of the printhead 102, and a printing sheet as a printing medium is fed below the lower surface.

To mount the power supply for supplying power on the carriage board A 110, as shown in FIG. 9, the carriage board in FIG. 7 must be enlarged upward, and the power supply must be mounted on the enlarged carriage board. However, if the board is enlarged upward, as shown in FIG. 9, the board hits against the cover of the ink-jet printer main body. The conventional outer cover cannot be directly used, and the specifications must be changed to enlarge the outer cover.

This specification change increases not only the manufacturing cost but also the ink-jet printer installation volume. This degrades the compactness in installation which is one of important product properties of the ink-jet printer. Also when the carriage board A 110 is enlarged (not shown) in the carriage moving direction (main scanning direction, i.e., right-to-left direction viewed from the front of the printer) in order to mount the power supply for supplying power, the outer case must be enlarged in the right-to-left direction, increasing the installation area. Also in this case, the same problems as those described above occur.

[Problem 2]

Large-format printers are mainly for business purposes. Due to heavy duty, a load change absorbing decoupling capacitor (also serving as an output capacitor for a DC/DC converter) must be exchanged, which is difficult to perform.

In FIG. 6, the current $I_{Prhd}$) supplied from the power supply unit board 103 to the printhead 102 changes in accordance with the printing image, as described above. The printing elements (nozzles) of the printhead 102 change from "a state in which no ink is discharged" to "a state in which all nozzles assigned for simultaneous driving discharge ink". The load change changes the driving voltage of another head board (HB) mounted in the printhead. To prevent the voltage change, a load change absorbing decoupling capacitor 106 is mounted.

To satisfy both the photographic quality and high-speed printing, the electric energy amount (power) supplied to the printhead increases in proportion to the load. Along with this, the load changes greatly, and a large ripple current ($I_{cripple}$) flows into the load change absorbing decoupling capacitor 106. The decoupling capacitor 106 generates heat by itself owing to the equivalent series-resistance (ESR) of the decoupling capacitor 106 and the flowing ripple current ($I_{cripple}$), shortening the service life of the decoupling capacitor 106.

Particularly in a heavy-duty, large-format business ink-jet printer, a printhead 112 is set as a replaceable component with a fatigue life. The arrangement of the load change absorbing decoupling capacitor 106 is set in advance so as to allow replacing it in periodic maintenance. This is convenient for the user because he/she can use the ink-jet printer main body for a long term. In the conventional ink-jet printer, however, the arrangement is not set in the above way, and it is difficult to replace a degraded load change absorbing decoupling capacitor.

SUMMARY OF THE INVENTION

The present invention has been made to overcome the conventional drawbacks, and has as its object to provide an image printing apparatus capable of stably supplying to a printhead a voltage necessary to realize stable image printing, and maintaining a compact shape in an ink-jet printer required for a larger area, higher photographic quality, and higher-speed printing in the future.

To achieve the above object, an image printing apparatus according to an aspect of the present invention has the following arrangement. That is, there is provided an image printing apparatus in which a carriage which supports a printhead having a plurality of printing elements is scanned on a printing medium on the basis of input printing data to print an image, the carriage comprising a first print circuit board having voltage conversion means for converting a voltage supplied from an apparatus main body, and a second board having smoothing means for smoothing the converted voltage, and the printhead using the smoothed voltage as driving power.

For example, the voltage conversion means preferably comprises a voltage conversion circuit which increases or decreases the supplied voltage.

For example, the smoothing means preferably includes a capacitor.

For example, the first print circuit board and the second print circuit board are preferably connected by a power supply line which supplies driving power to the printhead.

For example, the power supply line preferably comprises a power supply line for supplying power and a plurality of GND lines having different GND potentials.

For example, one of the plurality of GND lines is preferably connected to a constant-voltage control circuit of the voltage conversion means.

For example, it is preferable that the image printing apparatus comprises a main body print circuit board having generation means for generating an image signal to be transmitted to the printhead, and the first print circuit board and the main body print circuit board be connected by a flexible electric wiring line.

For example, the first print circuit board and the main body print circuit board preferably further comprise signal transmission buffer means for stably transmitting and receiving the image signal.

For example, the signal transmission buffer means preferably stably transmits and receives the image signal by using an LVDS (Low Voltage Differential Signaling).

For example, the image printing apparatus preferably comprises an ink-jet printhead which discharges ink to print information.

For example, the printhead preferably includes a printhead which discharges ink by using heat energy, and comprises a heat energy converter for generating heat energy to be applied to ink.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

First Embodiment

The first embodiment of the present invention will be described below with reference to the accompanying drawings.

The following embodiment will exemplify an ink-jet printer as a printing apparatus using an ink-jet printing method.

In this specification, "print" or "printing" is to form an image, design, pattern, or the like on a printing medium or process a medium regardless of whether to form significant information such as a character or figure, whether information is significant or insignificant, or whether information is so visualized as to allow a user to visually perceive it.

"Printing media" are not only paper used in a general printing apparatus, but also ink-receivable materials such as cloth, plastic film, metal plate, glass, ceramics, wood, and leather.

"Ink" (to be also referred to as "liquid") should be interpreted as broadly as the definition of "printing (print)". "Ink" represents a liquid which is applied to a printing medium to form an image, design, pattern, or the like, process the printing medium, or contribute to ink processing (e.g., solidification or insolubilization of a coloring material in ink applied to a printing medium).

Figure 12:
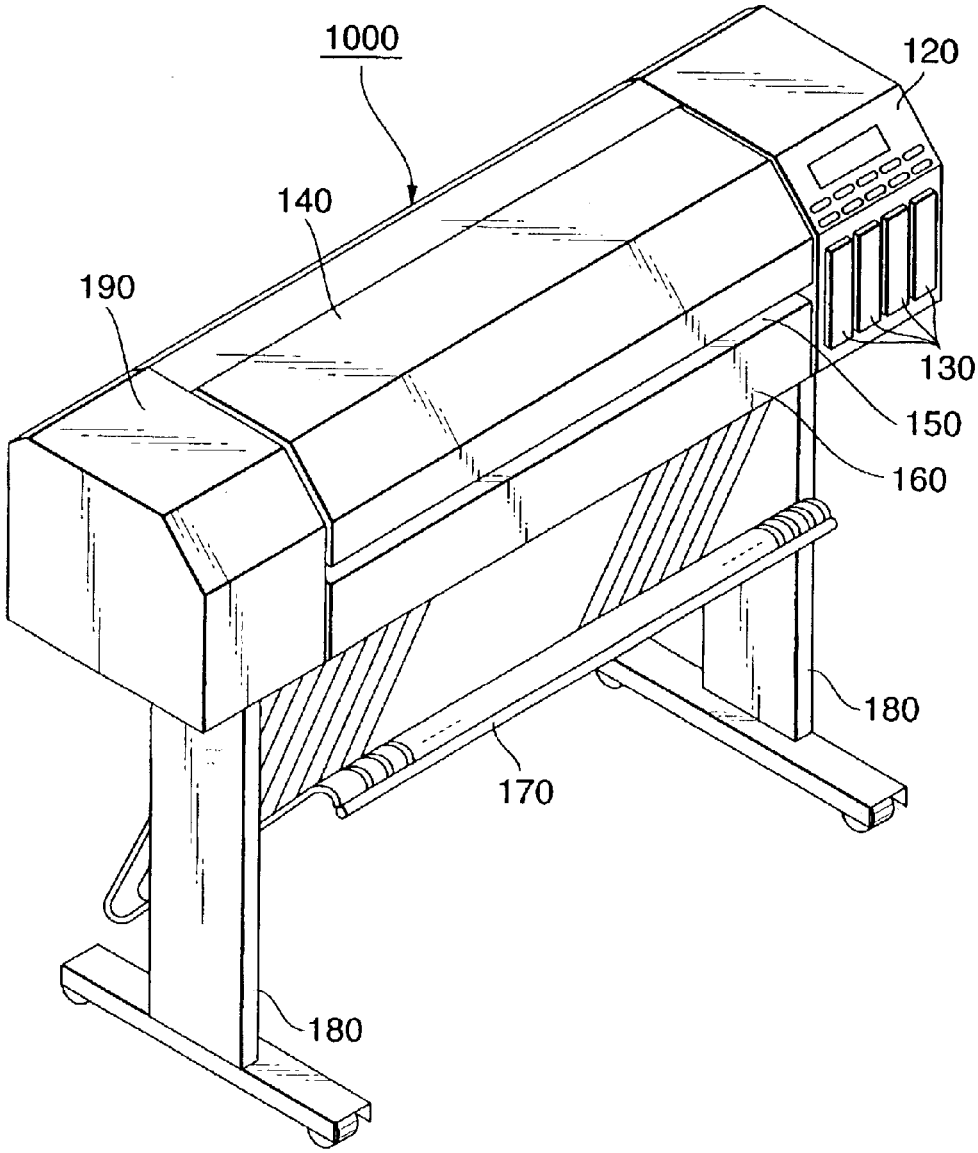
FIG. 12 is a perspective view showing the outer appearance of an ink-jet printer.
Figure 13:
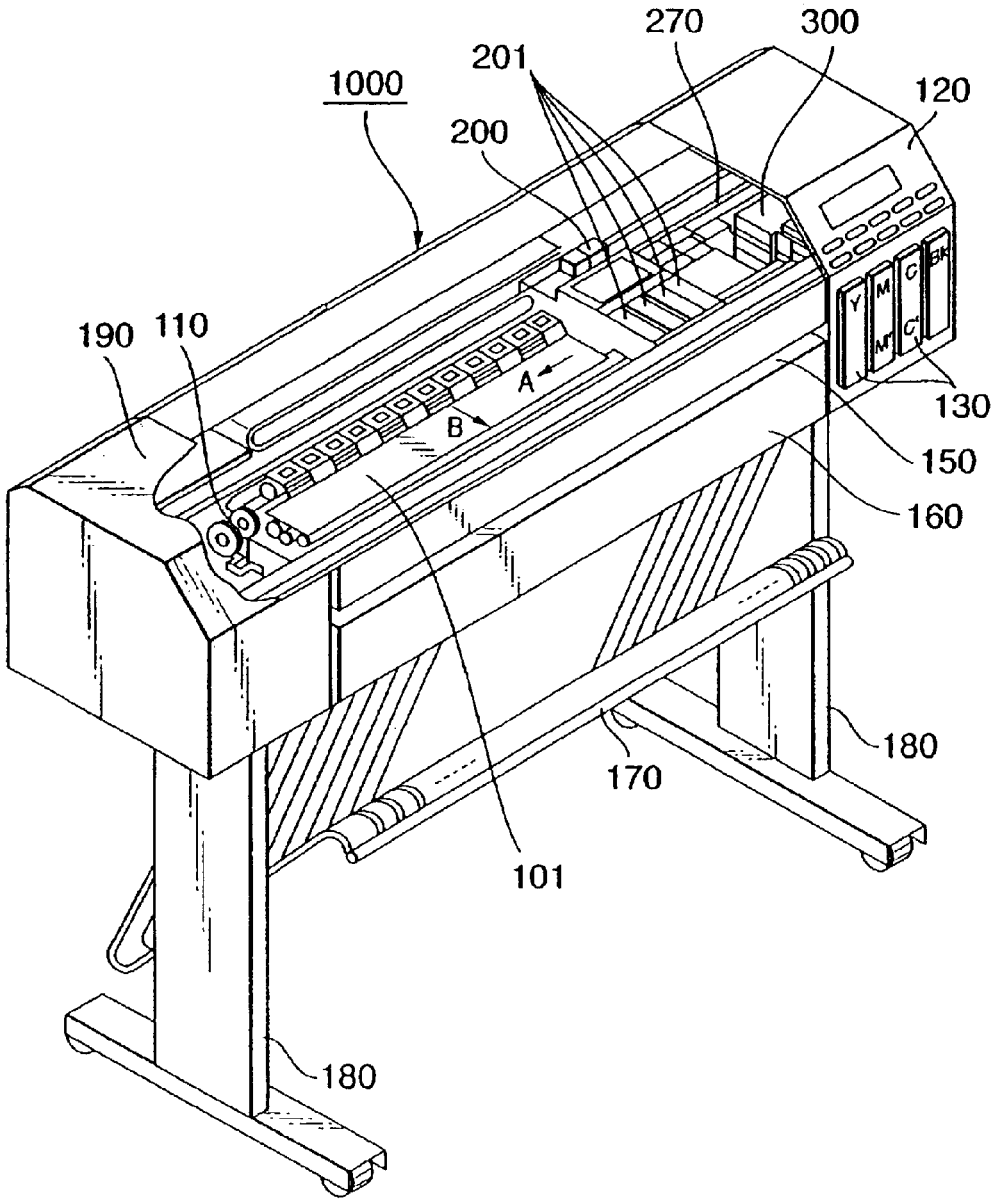
FIG. 13 is a perspective view showing a state in which the upper cover of the ink-jet printer is removed.

[Ink-Jet Printer (Large-Format Printer): FIGS. 12 and 13]

FIG. 12 is a perspective view showing the outer appearance of an ink-jet printer 1000. FIG. 13 is a perspective view showing a state in which the upper cover of the ink-jet printer 1000 in FIG. 12 is removed.

In FIGS. 12 and 13, a manual feed port 150 is formed in the front surface of the ink-jet printer 1000, and a roll unit 160 openable to the front is arranged below the manual feed port 150. A printing medium 101 (FIG. 13) such as a printing sheet is supplied from the manual feed port 150 or roll unit 160 to a printing portion.

The ink-jet printer 1000 comprises an ink-jet printer main body 190 supported by two legs 180, a stacker 170 which stacks discharged printing media 101, and a transparent openable/closable upper cover 140 which allows the interior to be visible.

As shown in FIG. 13, an operation panel 120, supply/recovery unit 300, and ink tanks 130 are arranged on the right side of the ink-jet printer main body 190. The supply/recovery unit 300 supplies ink from the ink tank 130 to an ink reservoir (sub-tank: not shown). In addition, the supply/recovery unit 300 suctions ink from the orifice of a printhead 201 to eliminate an ink discharge error caused by clogging of the orifice of the printhead 201, thereby maintaining and recovering the discharge performance.

As shown in FIG. 13, the ink-jet printer 1000 further comprises a pair of convey rollers 110 for conveying the printing medium 101 in a subscanning direction indicated by an arrow B, a carriage 200 which is guided and supported reciprocally in the widthwise direction of the printing medium 101 (main scanning direction indicated by an arrow A), a carriage motor (not shown) and belt means 270 for reciprocating the carriage 200 in the direction indicated by the arrow A, and the printhead 201 serving as a printing means mounted on the carriage 200.

The carriage 200 supports a plurality of printheads 201 for color printing on the printing medium 101. The printheads 201 are formed from four printheads 201 corresponding to inks of different colors (e.g., Y (Yellow) head, M (Magenta) head, C (Cyan) head, and Bk (Black) head).

To print information on the printing medium 101 by using the ink-jet printer 1000 having the above arrangement, the pair of convey rollers 110 convey the printing medium 101 to a predetermined printing start position. Main scanning by the printhead 201 and subscanning by the convey rollers 110 are repeated to print information on the entire printing medium 101.

More specifically, the carriage belt 270 and the carriage motor (not shown) move the carriage 200 from a predetermined position in the main scanning direction to the direction indicated by the arrow A in FIG. 13, to start printing on the printing medium 101.

After main-scanning printing ends, the carriage 200 is returned to a predetermined position in the main scanning direction (predetermined position before the start of main scanning printing). The printing medium 101 is conveyed by the pair of convey rollers 110 by a predetermined amount in the subscanning direction (direction indicated by the arrow B in FIG. 13).

As described above, the carriage belt 270 and the carriage motor (not shown) again move the carriage 200 from the predetermined position in the main scanning direction in the direction indicated by the arrow A in FIG. 13, in order to print an image, character, or the like on the printing medium 101.

By repeating the above-described operation, printing of one printing medium 101 ends. The printing medium 101 is then discharged into the stacker 170, completing recording of one printing medium 101.

Figure 14:
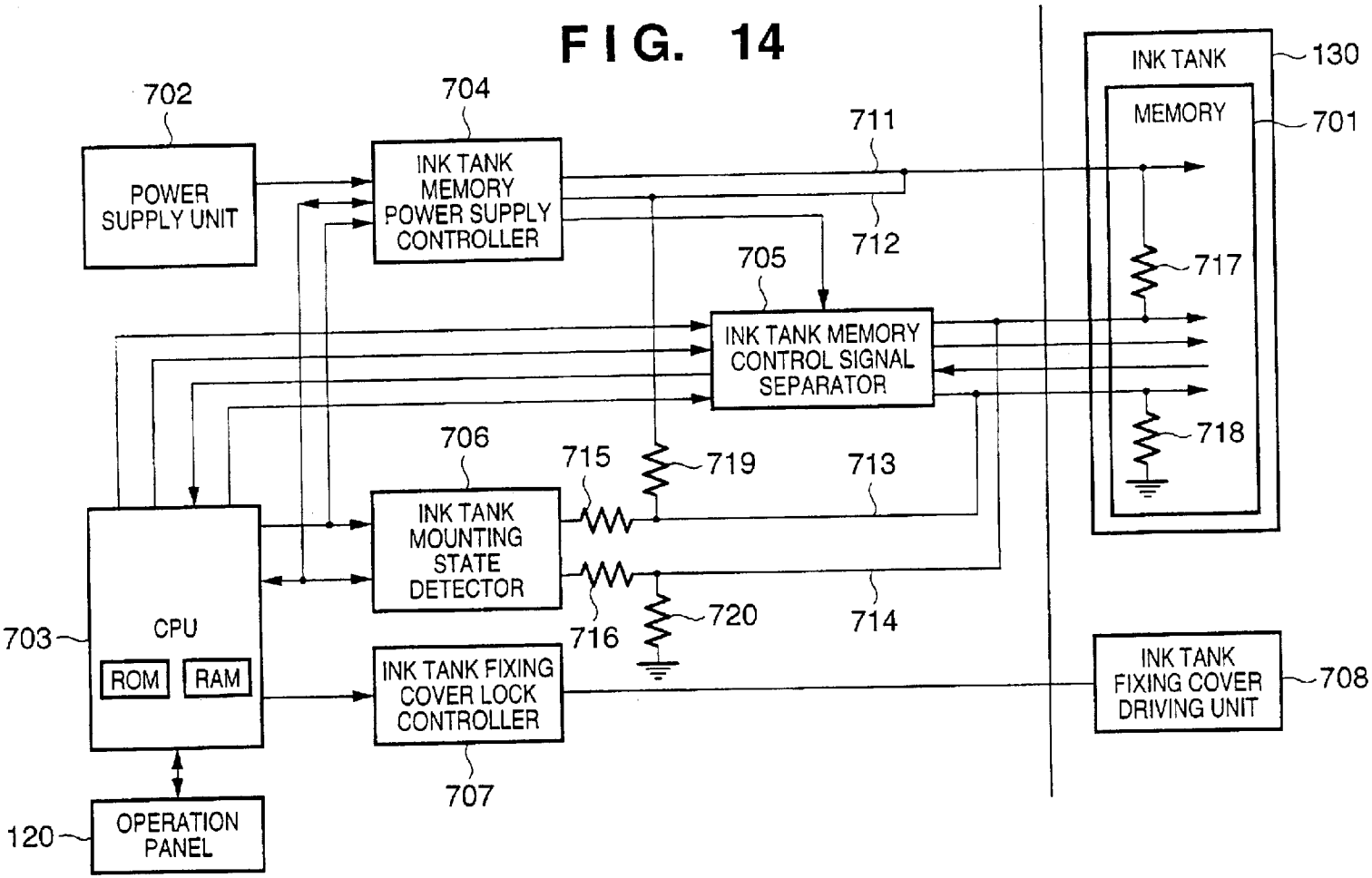
FIG. 14 is a block diagram showing the arrangement of the controller of the ink-jet printer.

[Controller of Ink-Jet Printer: FIG. 14]

FIG. 14 is a block diagram showing the arrangement of the controller of the ink-jet printer shown in FIG. 12.

In FIG. 14, reference numeral 702 denotes a power supply unit which supplies a voltage for operating the ink-jet printer main body 190; and 701, a memory which stores information about the ink tank. The ink tank 130 comprises this memory (the memory 701 is arranged in the ink tank). Reference numeral 703 denotes a CPU which incorporates memories (RAM, ROM, and the like) for controlling the overall ink-jet printer; and 704, a controller which supplies power to the memory arranged in the ink tank, and turns on/off a power supply for supplying power from the power supply unit 702 to the memory 701 arranged in the ink tank.

The operation panel 120 has a display which externally displays the state of the ink-jet printer main body 190, and an input unit for performing various operations of the ink-jet printer 1000. Reference numeral 705 denotes a separator which separates a control signal to the memory arranged in the ink tank and changes a control signal to a high impedance for the ink tank 130; 706, an ink tank mounting state detector which detects the mounting state of the ink tank 130; 707, an ink tank fixing cover lock controller which inhibits or allows dismounting/mounting of the ink tank 130; and 708, an ink tank fixing cover lock driving unit which locks an ink tank fixing cover (not shown).

Reference numeral 711 denotes a power supply which is turned on/off by the controller 704 for supplying power to the memory arranged in the ink tank, and supplies power from the power supply unit 702 to the ink tank memory 701; and 712, a power supply used when restricting a power supply current supplied from the controller 704 for supplying power to the memory arranged in the ink tank.

Reference numerals 713 and 714 denote a chip select signal and serial clock signal which are control signals for the memory 701 arranged in the ink tank and are supplied to the ink tank 130 via electric contacts (not shown) attached to the ink tank 130.

Reference numerals 715 and 716 denote protection resistors for protecting the ink tank mounting state detector 706 in detecting the mounting state of the ink tank 130; 717, a logic fixing pull-up resistor arranged in the ink tank 130 for the serial clock signal 714; and 718, a logic fixing pull-down resistor arranged in the ink tank 130 for the chip select signal 713.

Reference numeral 719 denotes a pull-up resistor which is higher in resistance than the logic fixing pull-down resistor 718 arranged in the ink tank 130 for the chip select signal 713; and 720, a pull-down resistor which is higher in resistance than the logic fixing pull-up resistor 717 arranged in the ink tank 130 for the serial clock signal 714.

Although not shown in FIG. 14, the CPU 703 controls the operations of the above-described units in accordance with control programs (not shown) stored in the ROM. The CPU 703 is connected to a driving motor (not shown) for reciprocating the carriage 200 in FIG. 13, a motor (not shown) for driving the supply/recovery unit 300, a motor for conveying the printing medium 101, and the like. The CPU 703 also controls the operations of these motors in accordance with predetermined programs (not shown) stored in the ROM.

Figure 1:
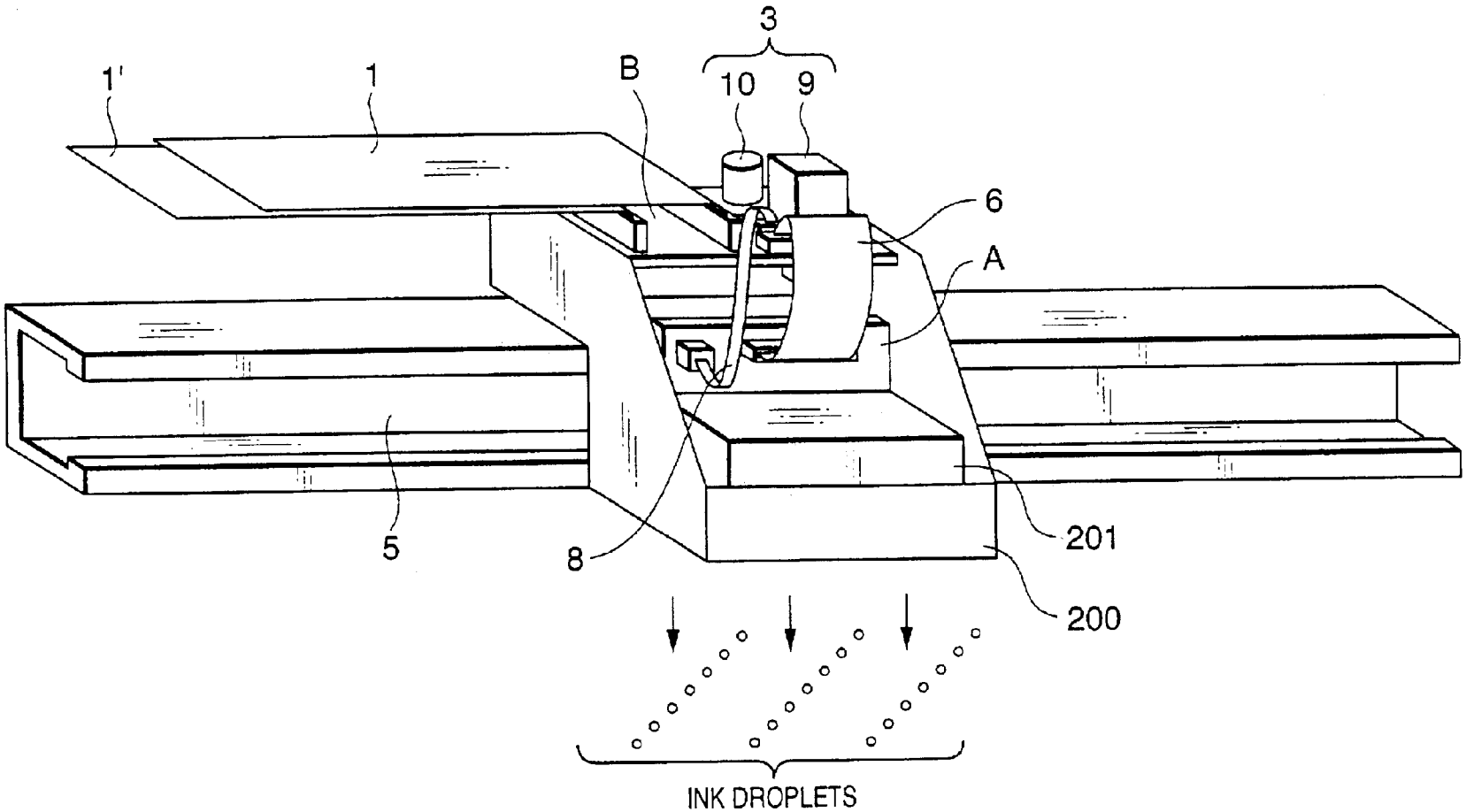
FIG. 1 is a perspective view showing a carriage and its vicinity according to the first embodiment of the present invention.

[Carriage Arrangement: FIG. 1]

FIG. 1 is a perspective view showing the carriage 200 and its vicinity according to the first embodiment of the present invention. FIG. 1 illustrates a simple arrangement for only a portion necessary for the description of the present invention, and does not illustrate any main body system, ink supply system, or the like.

Figure 2:
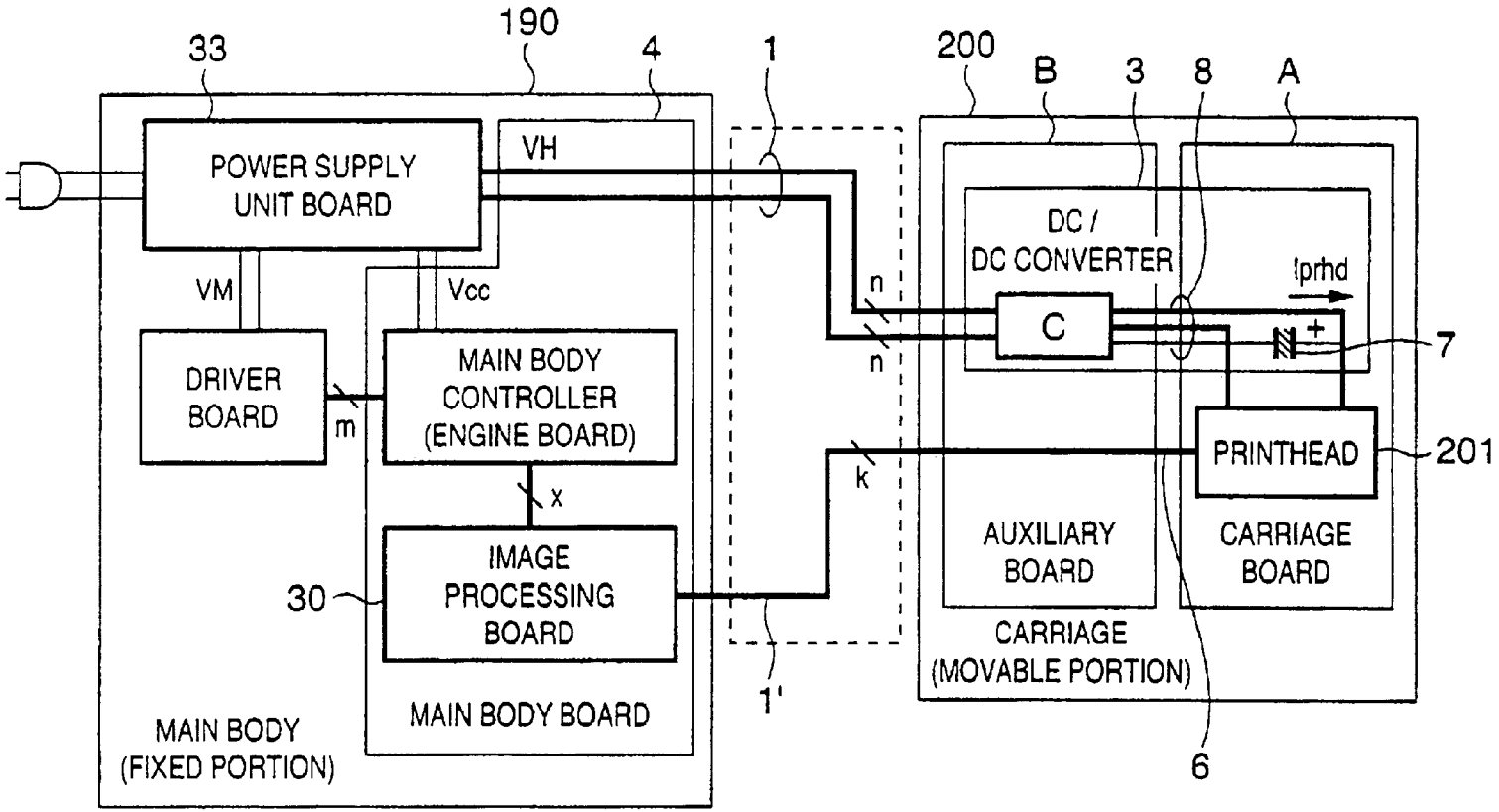
FIG. 2 is a block diagram showing the electrical system of an overall printer according to the first embodiment of the present invention.

[Electrical System of Overall Printer: FIG. 2]

Figure 3:
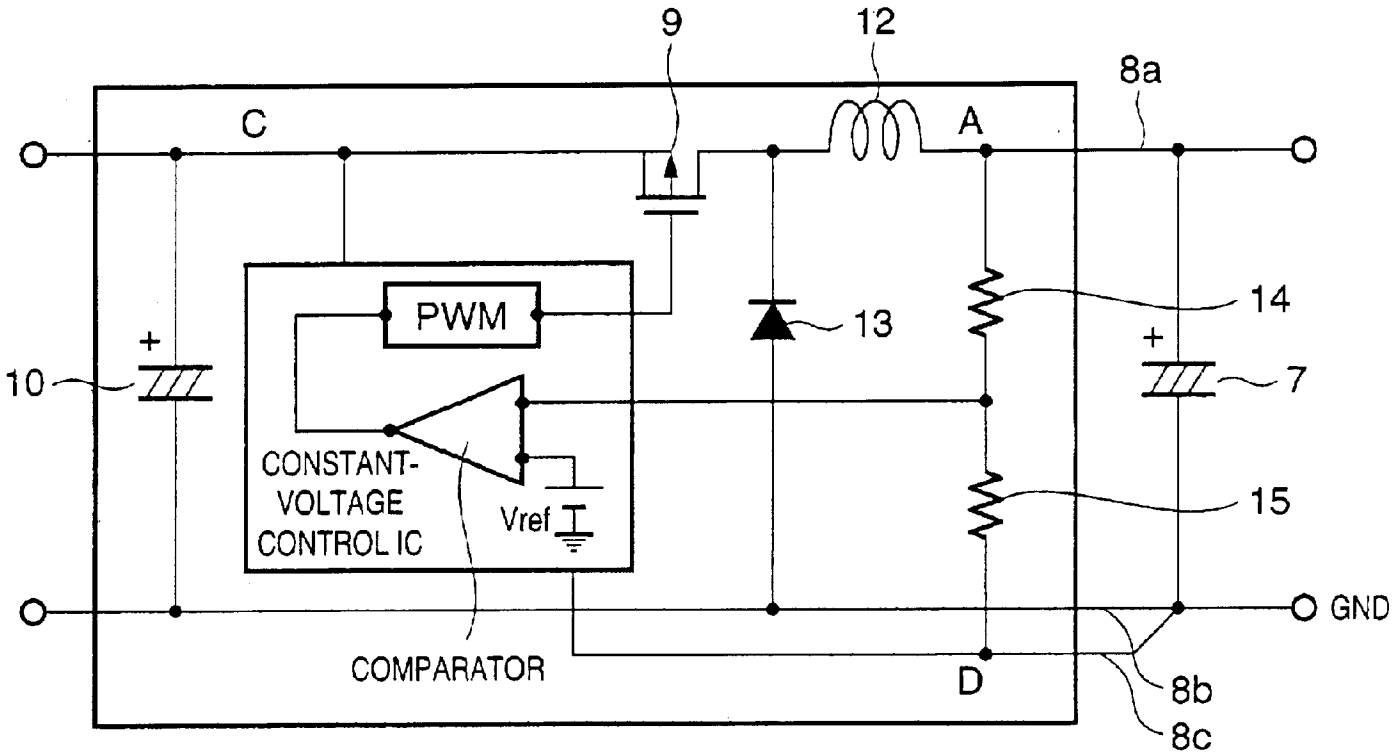
FIG. 3 is a circuit diagram showing the internal arrangement of a DC/DC converter 3 according to the first embodiment of the present invention.

FIG. 2 is a block diagram showing the electrical system of the overall ink-jet printer. Similar to FIG. 1, FIG. 2 illustrates a simple arrangement for only a portion necessary for the description of the present invention, and does not illustrate any carriage motor, paper feed motor, or the like. FIG. 3 is a circuit diagram showing in detail the internal arrangement of a DC/DC converter 3 shown in FIG. 2.

The arrangements of the carriage 200 and ink-jet printer main body 190 will be explained with reference to FIGS. 1 to 3. In FIGS. 1 to 3, the same reference numerals denote the same parts.

In FIG. 1, reference symbols A and B denote a carriage board and auxiliary board as two divided mounting boards. Reference numerals 1 and 1' denote flexible wiring conductors (flexible wiring boards, wiring lines called "flat cables", or the like); 201, a printhead; 3, the DC/DC converter; and 4, a main body board within the printer main body.

The flexible wiring conductor 1 supplies power from a power supply unit board 33 arranged within the printer main body to the DC/DC converter 3 via the main body board 4. The flexible wiring conductor 1 is made up of (2×n) wiring patterns, and assigned n wiring patterns for each of power supply and GND (ground or reference potential) wiring. A voltage VH supplied from the power supply unit board 33 to the DC/DC converter 3 is, e.g., 18 V.

The other flexible wiring conductor 1' is a wiring conductor having k wiring patterns for transmitting a printing image signal and printhead control signal from an image processing board 30 of the main body board 4 to the printhead 201. The flexible wiring conductor 1' connects the image processing board 30 and the auxiliary board B serving as a mounting board via a connector (not shown).

As shown in FIG. 1, the carriage board A and auxiliary board B are connected by a flexible wiring board 6 and wiring conductor 8, and separately arranged on the carriage 200 capable of moving integrally with the boards A and B. The carriage board A and auxiliary board B are mounted such that their component mounting surfaces are oriented in different directions (i.e., the carriage board A is arranged vertically, whereas the auxiliary board B is arranged horizontally). This is the first feature of the present invention.

With this feature, the mounting space can be effectively utilized on the carriage 200, and components can be compactly mounted. That is, the upper cover of a conventional ink-jet printer which does not incorporate a DC/DC converter serving as a power supply for supplying power to the printhead can be directly used. An increase in manufacturing cost upon a specification change can be prevented, and the compactness of the ink-jet printer can be maintained.

In the DC/DC converter 3 shown in FIG. 3, a circuit portion C surrounded by a rectangle represents a portion of the DC/DC converter 3 not including an output capacitor 7. The circuit portion C is mounted on the auxiliary board B.

In FIG. 1, reference numeral 5 denotes a carriage rail which is fixed to a printer main body frame. The flexible wiring board 6 has k wiring conductors. Reference numeral 7 denotes the load change absorbing decoupling capacitor which also serves as the output capacitor of the DC/DC converter. In terms of electrical characteristics, the load change absorbing decoupling capacitor 7 is preferably arranged as close as possible to the printhead 201 functioning as a load. In order to enhance the decoupling effect, a low-impedance decoupling capacitor is preferable. For this purpose, a plurality of capacitors may be parallel-connected.

The wiring conductor 8 electrically couples the auxiliary board B and carriage board A on which the DC/DC converter 3 is divisionally arranged. Reference numeral 9 denotes a MOS transistor serving as the main switching device of the DC/DC converter 3 (FIG. 1 shows a main switching device mounted on a heat sink).

Reference numeral 10 denotes an input capacitor for the DC/DC converter 3; 200, the printer carriage; 12, an inductor; 13, a freewheeling diode; and 14 and 15, output voltage detection resistors.

[Operation of DC/DC Converter: FIG. 3]

The operation of the DC/DC converter 3 will be briefly explained with reference to FIG. 3.

A circuit as shown in FIG. 3 is a so-called step-down circuit. When the MOS transistor 9 is ON, the current is supplied to the load and output capacitor 7 via the inductor 12.

When the MOS transistor 9 is OFF, the current flowing through the inductor 12 tends to decrease. Counterelectromotive (Back electromotive) force is generated by the nature of the inductor 12 to turn on the freewheeling diode 13. The current is then supplied to the load and output capacitor 7 via a path of the GND, freewheeling diode 13, and inductor 12.

The output capacitor 7 is discharged if a current supplied from the C block is insufficient in accordance with the load, and charged if the current is sufficient. When the load is light and the charging current increases, the potential across the output capacitor 7 rises. The output voltage is divided and detected by the output voltage detection resistors 14 and 15.

The ON/OFF time of the MOS transistor 9 is PWM (Pulse Width Modulation)-controlled and feedback-controlled by a constant-voltage control IC so as to keep the output voltage at a predetermined set voltage. In this manner, a stable voltage is supplied to the printhead 201.

A division method of dividing the DC/DC converter 3 for the carriage board A and auxiliary board B, and wiring conductors which are electrically coupled to each other will be explained as the second feature of the present invention.

Figure 11:
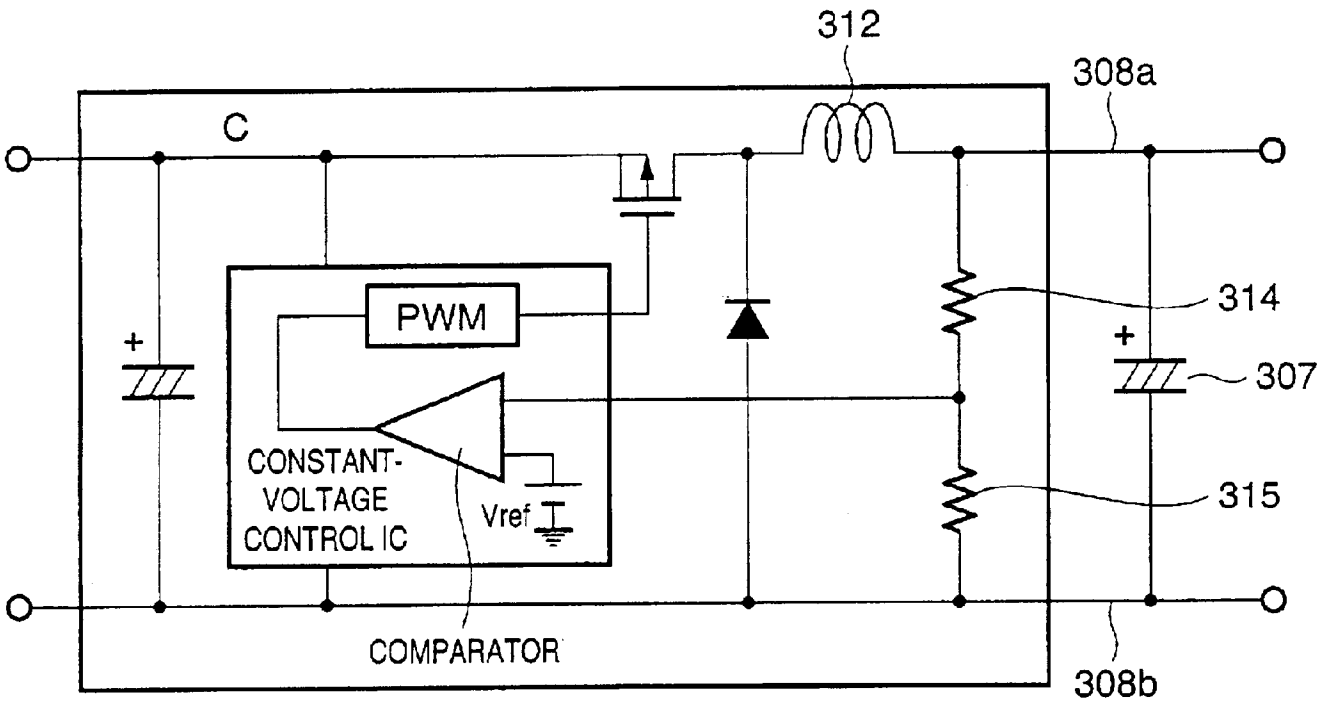
FIG. 11 is a circuit diagram showing a prior art of simply divisionally mounting the DC/DC converter.

[Problem in Simple Division of DC/DC Converter: FIG. 11]

FIG. 11 shows an example of simply dividing the DC/DC converter 3 into an output capacitor 307 and remaining portion C. At this time, output voltage detection resistors 314 and 315 are arranged within the C block and mounted on the auxiliary board B. Detection points are set on the output side of an inductor 312. For this reason, the wiring conductor 8 which electrically couples the auxiliary board B and carriage board A on which the DC/DC converter 3 is divisionally arranged is formed from two lines, a power supply line 308*a* and GND line 308*b*.

In this case, if the load of the printhead 201 serving as the load of the DC/DC converter increases (e.g., a current larger than 7 A flows in a large-format printer), voltage drops occur in both the power supply line 308*a* and GND line 308*b*. Depending on image printing conditions, a voltage supplied to the printhead 201 decreases to a predetermined voltage or less, failing to discharge ink from the printhead 201.

Figure 10:
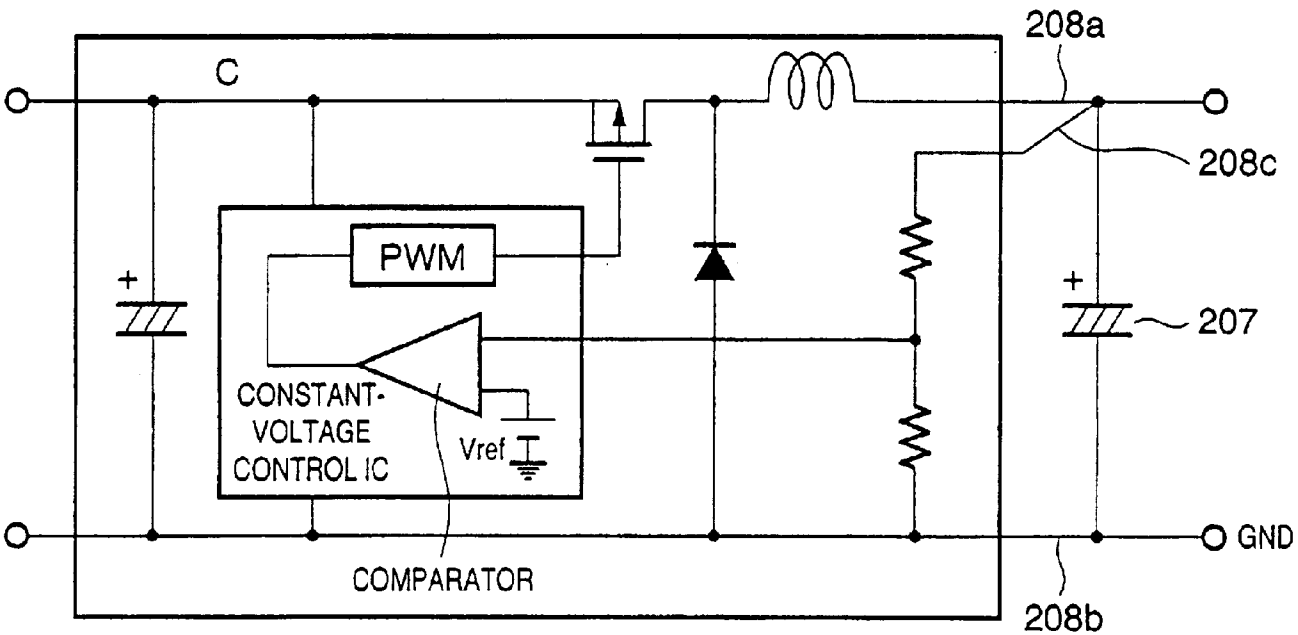
FIG. 10 is a circuit diagram showing an improved prior art of divisionally mounting a DC/DC converter.

[Another Problem in Division of DC/DC Converter: FIG. 10]

In order to solve the problem shown in FIG. 11, output voltage detection points are set near the positive terminal of a capacitor 207 on the carriage board A in FIG. 10. The voltage is fed back to the auxiliary board B via an output voltage detection line 208*c*. In this case, the wiring conductor 8 which electrically couples the auxiliary board B and carriage board A on which the DC/DC converter 3 is divisionally arranged is formed from three lines, a power supply line 208*a*, a GND line 208*b*, and the output voltage detection line 208*c*.

In FIG. 10, however, the wiring inductance component of the output voltage detection line 208*c* acts as a phase delay element in the feedback loop, degrading the response characteristic to the load and the stability of constant-voltage control. In practice, this method cannot be employed.

[Method of Dividing DC/DC Converter for Two Boards: FIG. 3]

To solve the above problems, as shown in FIG. 3, ground is separated from the negative terminal of the output capacitor 7 on the carriage board A. Ground is connected to the C block on the auxiliary board B by using three wiring conductors: a GND line 8*b* for supplying a main load current, a GND line 8*c* for detecting a voltage datum; and a power supply line 8*a*.

The detection points GND of the output voltage detection resistors 14 and 15 and the control system GND of the constant-voltage control IC of the DC/DC converter 3 are set near the negative terminal of the output capacitor 7 of the carriage board A and separated from the ground line. The load current does not flow through the GND line 8*c* or cause a voltage drop at the point D. Even if an excessive load current flows, stable feedback control can be ensured.

Compared to the method shown in FIG. 11, the method of FIG. 3 can suppress a voltage drop caused by the load current of the GND line 8*b* to be equal to a voltage drop caused by the load current in FIG. 10. This method is, therefore, suitable for dividing the DC/DC converter for two boards.

As described above, according to the first embodiment, the DC/DC converter 3 can be mounted on the auxiliary board B, whereas the printhead 201 and output capacitor 7 can be mounted on the carriage board A. The decoupling capacitor 7 which absorbs a load change in printing can be mounted at a low impedance near the printhead 201 which generates a load change on the carriage board A 100 which holds the printhead 201.

A voltage drop caused by a load change in printing can be suppressed, and the voltage does not become lower than a printing voltage necessary for the printhead 201. As a result, an ink discharge error can be prevented.

Figure 8:
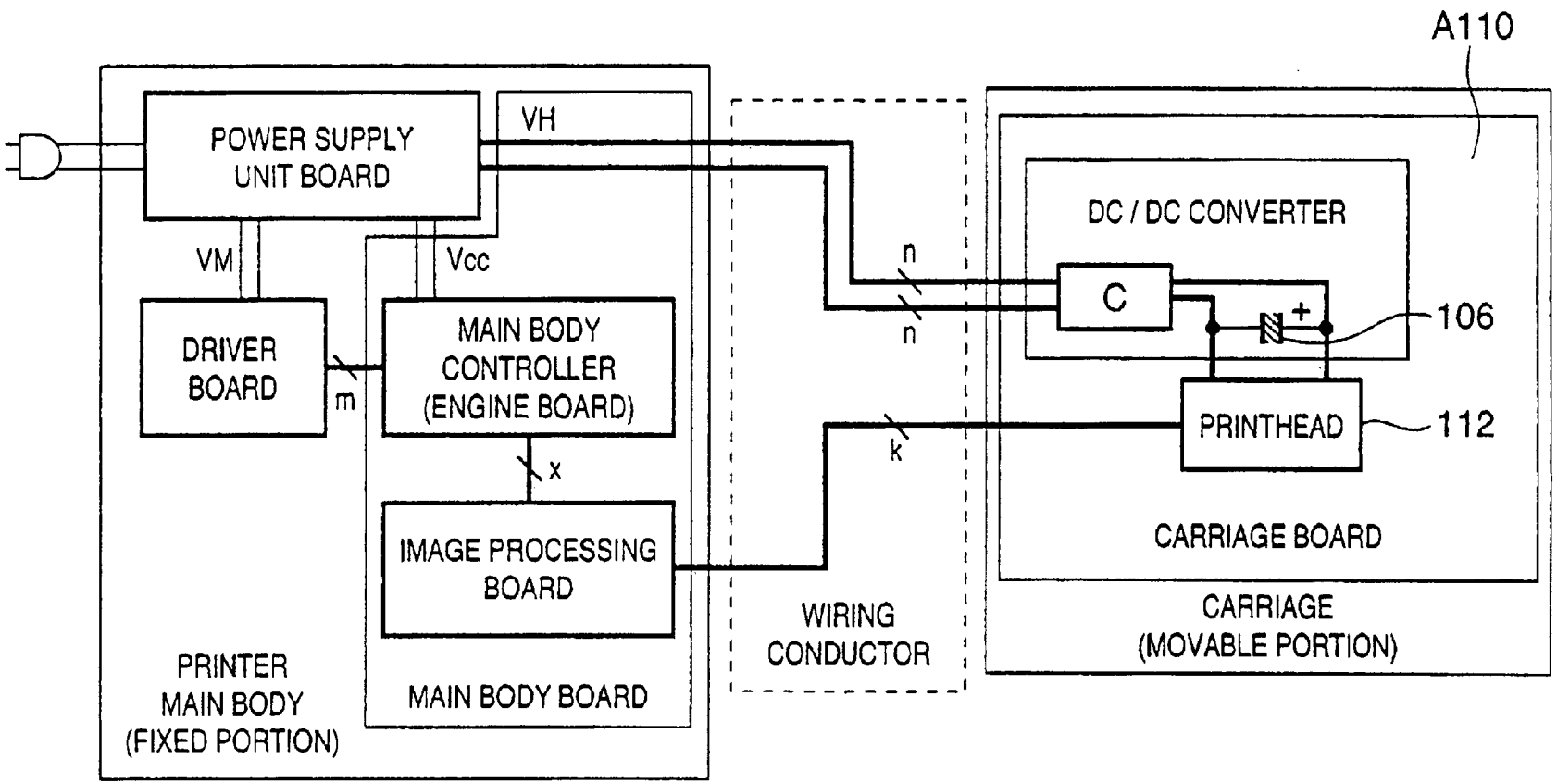
FIG. 8 is a block diagram showing the power supply system of an ink-jet printer when a power supply is mounted on a carriage board.
Figure 9:
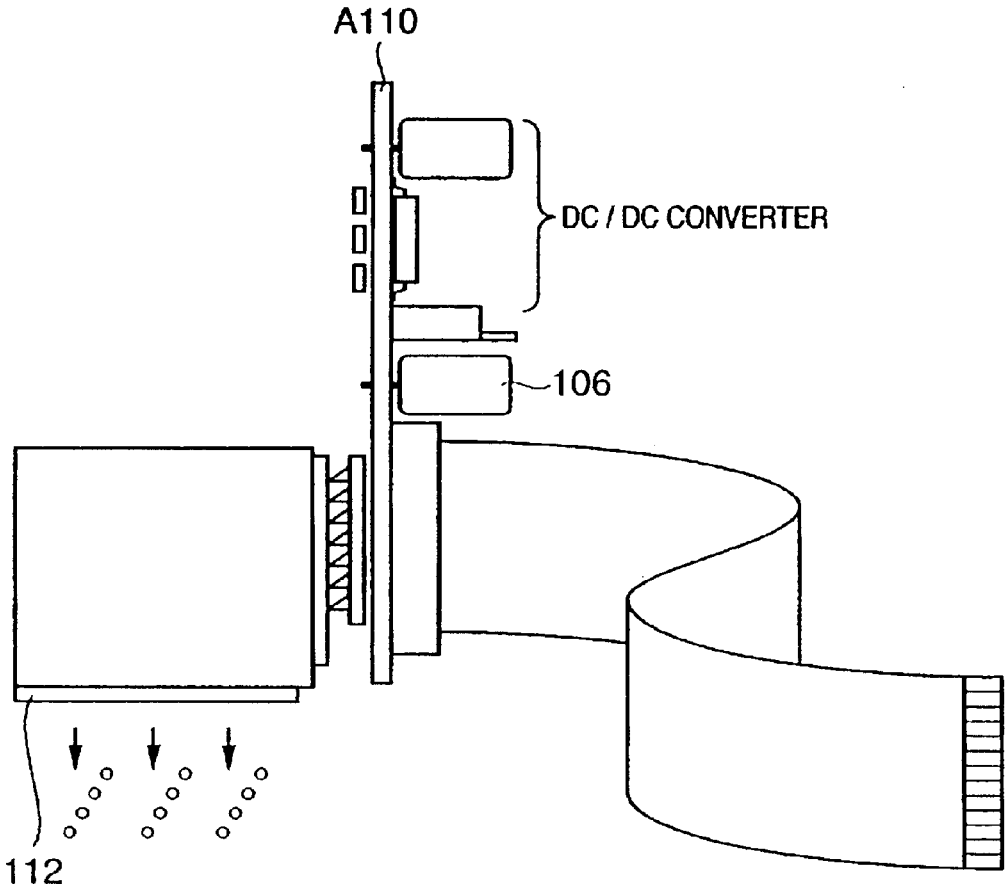
FIG. 9 is a side view showing a carriage electric mounting portion when the power supply is mounted on the carriage board.

The capacitor 7 as a limited-life component can be easily replaced by only dismounting the carriage board A without replacing the whole DC/DC converter 3 (corresponding to A 110 in FIGS. 8 and 9), unlike the prior art, thereby decreasing the cost.

The mounting board is divisionally arranged on the two boards, as described above. The entire carriage can be made compact without any mounting restrictions on the carriage mounting board in the ink discharge direction. Even if the DC/DC converter is arranged on the carriage, this structure does not make the outer printer size excessively large.

The first embodiment has exemplified one capacitor 7 for descriptive convenience, but a plurality of capacitors 7 may be parallel-arranged to realize a low impedance, as described above. In this case, the capacitors 7 may be respectively arranged on the carriage board A and auxiliary board B.

Second Embodiment

The second embodiment will be explained. In the second embodiment, a repetitive description of the first embodiment will be omitted. The same reference numerals as in the first embodiment denote the same parts, and a description thereof will be omitted.

Figure 4:
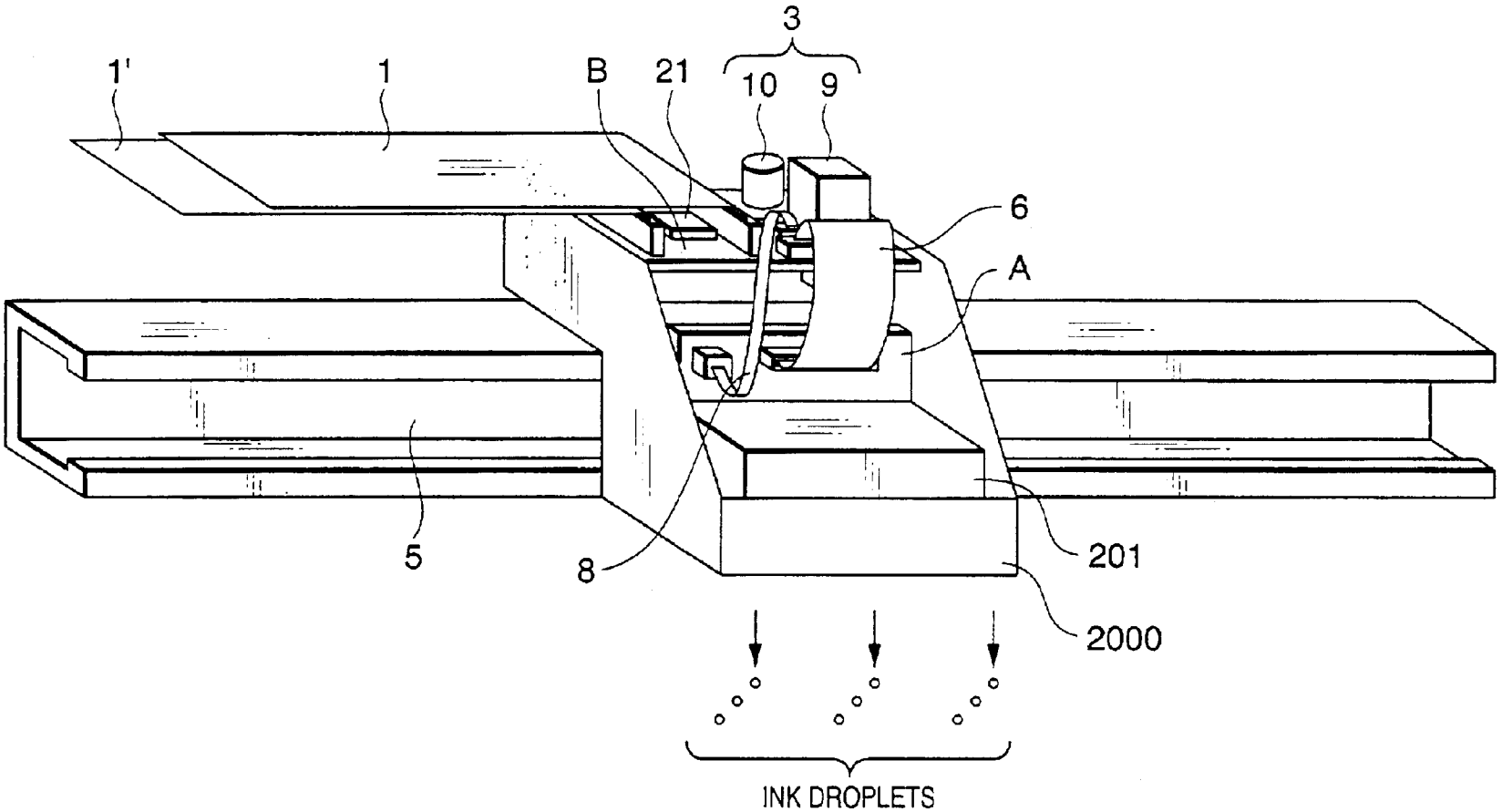
FIG. 4 is a perspective view showing a carriage and its vicinity according to the second embodiment of the present invention.
Figure 5:
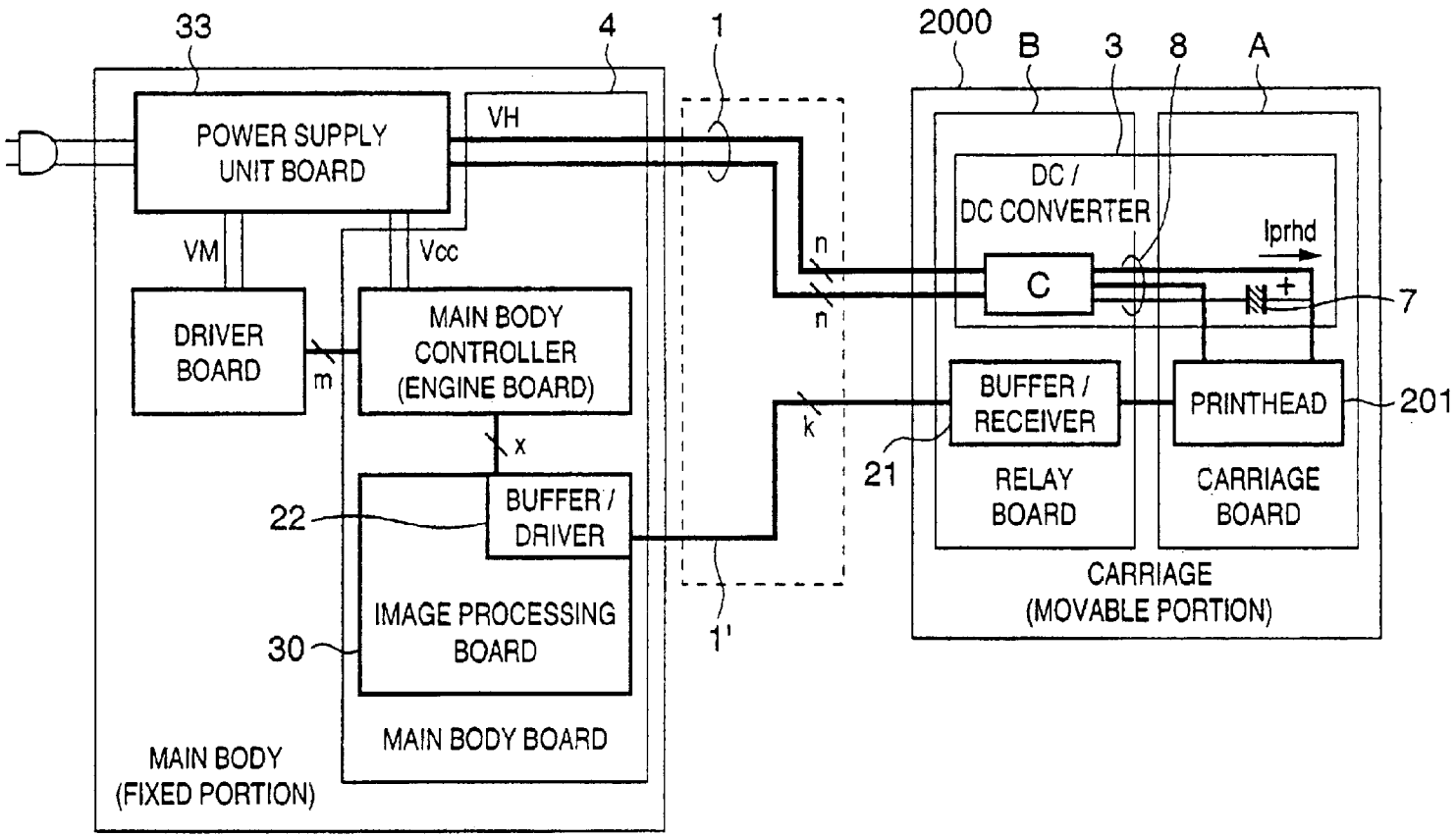
FIG. 5 is a block diagram showing the electrical system of an overall printer according to the second embodiment of the present invention.
Figure 6:
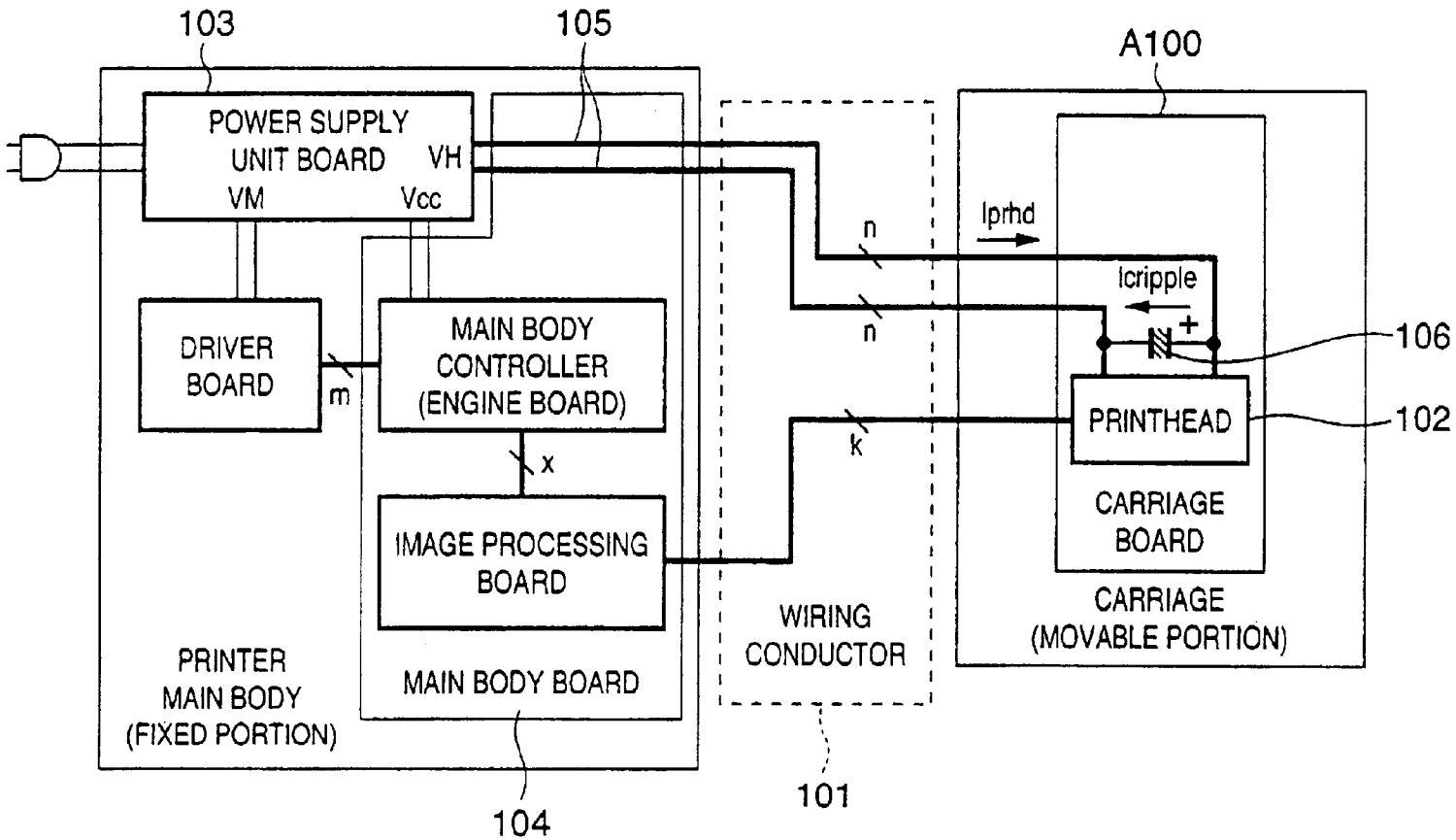
FIG. 6 PRIOR ART
FIG. 6 is a block diagram showing the power supply system of a conventional ink-jet printer.
Figure 7:
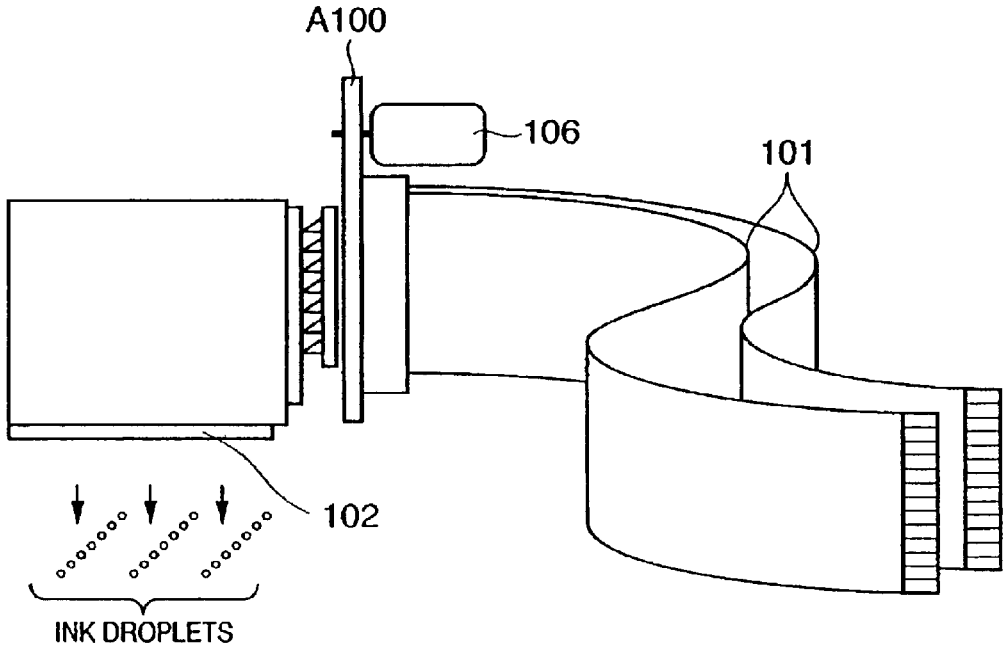
FIG. 7 PRIOR ART
FIG. 7 is a side view showing a carriage electric mounting portion mounted on the carriage of a conventional printer.

FIG. 4 is a perspective view showing a carriage 2000 and its vicinity according to the second embodiment of the present invention. FIG. 5 is a block diagram showing the electrical system of an ink-jet printer according to the second embodiment of the present invention.

The second embodiment is different from the first embodiment in that a buffer circuit, driver circuit, and receiver circuit such as a buffer/receiver 21 and buffer/driver 22 serving as signal transmission buffer means for stable signal transmission are used for signal transmission of a flexible wiring conductor 1' having k wiring patterns for transmitting a printing image signal and printhead control signal to be supplied from the image processing board of a main body board 4 to a printhead 201.

As described above, in a large-format printer, the flexible wiring conductor 1' exceeds 1 meter including internal wiring. It becomes difficult to transmit image data of a large image at a high speed. In terms of a measure against noise, the flexible wiring conductor 1' may disadvantageously function as a radiation noise source.

To prevent this, the second embodiment adopts signal transmission using an LVDS (Low Voltage Differential Signaling) proposed by National Semiconductor in order to transmit data at a high speed without any noise. To perform stable signal transmission, the buffer/receiver 21 is wanted to be mounted as close to the signal receiving side as possible.

However, it is difficult to ensure a satisfactory mounting space on the carriage board A. Hence, the signal transmission buffer/receiver 21 is mounted on the auxiliary board B. The mounting space can be effectively utilized on the carriage 2000, and components can be compactly mounted.

In the above embodiments, droplets discharged from the printhead are ink droplets, and a liquid stored in the ink tank is ink. However the liquid to be stored in the ink tank is not limited to ink. For example, a treatment solution to be discharged onto a printing medium so as to improve the fixing property or water resistance of a printed image or its image quality may be stored in the ink tank.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of a so-called on-demand type and continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence-with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region, is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head, as described in the above embodiment, which can be electrically connected to the apparatus main unit and can receive an ink from the apparatus main unit upon being mounted on the apparatus main unit but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a nonuse state and liquefies upon heating may be used. In any case, an ink which liquefies upon application of heat energy according to a printing signal and is discharged in a liquid state, an ink which begins to solidify when it reaches a printing medium, or the like, is applicable to the present invention.

In this case, as described in Japanese Patent laid Open No. 54-56847 or Japanese Patent Laid Open No. 60-71260, an ink may be supplied in a form of perforated sheet opposed to the electrothermal transducer in which the ink is maintained in liquid or solid within a dent or a through-hole thereon. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program code for performing the aforesaid processes to a computer system or apparatus (e.g., a personal computer), reading the program code, by a CPU or MPU of the computer system or apparatus, from the storage medium, then executing the program. In this case, the program code read from the storage medium realize the functions according to the embodiments, and the storage medium storing the program code constitutes the invention.

Further, the storage medium, such as a floppy disk, a hard disk, an optical disk, a magneto-optical disk, a CD-ROM, a CD-R, a magnetic tape, a non-volatile type memory card, and a ROM, can be used for providing the program code. Furthermore, additional functions according to the above embodiments are realized by executing the program code which are read by a computer. The present invention includes a case where an OS (operating system) or the like working on the computer performs a part of or an entire process in accordance with designations of the program code and realizes functions according to the above embodiments.

Furthermore, the present invention also includes a case where, after the program code read from the storage medium are written in a function expansion card which is inserted into the computer or in a memory provided in a function expansion unit which is connected to the computer, a CPU or the like contained in the function expansion card or function expansion unit performs a part of or an entire process in accordance with designations of the program code and realizes functions of the above embodiments.

In addition, the printing apparatus according to the present invention can take the form of an apparatus arranged as an integral or separate image output terminal for an information processing apparatus such as a computer, the form of a copying machine combined with a reader or the like, or the form of a facsimile machine having a transmission/reception function.

Other Embodiments

The present invention can be applied to a system constituted by a plurality of devices (e.g., host computer, interface, reader, and printer) or to an apparatus comprising a single device (e.g., copying machine or facsimile machine).

As has been described above, the ink-jet printer according to the above embodiments is characterized by comprising the following arrangement. More specifically, the mounting board which supports a printhead mounted on the carriage is divided and arranged. A capacitor is mounted on a board closer to the printhead out of the divided boards. A power converter (e.g., DC/DC converter) which converts power to be supplied to the printhead is mounted on the other board.

The board which supports the printhead and the board which supports the power converter are connected to each other by a signal line for driving the printhead and a power supply line for supplying printhead driving power. The power supply line for supplying energy for driving the printhead is made up of a power supply line, and a plurality of GND lines with different GND potentials.

In addition, the board mounted on the carriage and the main body board which generates a printing image signal are connected to each other by a flexible electric wiring board. Signal transmission buffer units, e.g., LVDSs (Low Voltage Differential Signaling) are respectively mounted on the board and main body board.

For future demands for a large area, photographic quality, and high-speed printing, the ink-jet printer having the above arrangement can supply stable driving power to the printhead that is necessary to realize stable image printing. Even if the power converter is mounted on the carriage, the carriage space can be appropriately used, keeping the ink-jet printer compact, similar to the conventional ink-jet printer.

The above embodiments have described a large-format ink-jet printer. However, the present invention is not limited to this, and can be applied to various normal-size printers such as one used in office or home. Also in this case, the same effects as those described above can be expected.

As has been described above, the present invention can provide an image printing apparatus capable of stably supplying to a printhead a voltage necessary to realize stable image printing, and maintaining a compact shape by properly using the carriage space in an image printing apparatus required for a larger area, higher photographic quality, and higher-speed printing in the future.

As many apparently widely different embodiments of the present invention can be made without departing from the spirit and scope thereof, it is to be understood that the invention is not limited to the specific embodiments thereof except as defined in the claims.

What is claimed is:

1. An image printing apparatus in which a printhead, having a plurality of printing elements and being supported on a carriage, scans a printing medium on the basis of input printing data to print an image, the carriage supporting a first print circuit board having voltage conversion means for converting a voltage supplied from an apparatus main body, and a second print circuit board having smoothing means for smoothing the converted voltage, and the printhead using the smoothed voltage as driving power.

2. The apparatus according to claim 1, wherein the voltage conversion means comprises a voltage conversion circuit which increases or decreases the supplied voltage.

3. The apparatus according to claim 1, wherein the smoothing means includes a capacitor.

4. The apparatus according to claim 1, wherein the first print circuit board and the second print circuit board are connected by a power supply line which supplies driving power to the printhead.

5. The apparatus according to claim 1, wherein a main body print circuit board having generation means for generating an image signal to be transmitted to the printhead is provided, and the first print circuit board and the main body print circuit board are connected by a flexible electric wiring line.

6. The apparatus according to claim 5, wherein the first print circuit board and the main body print circuit board further comprise signal transmission buffer means for stably transmitting and receiving the image signal.

7. The apparatus according to claim 6, wherein the signal transmission buffer means stably transmits and receives the image signal by using an LVDS (Low Voltage Differential Signaling).

8. The apparatus according to claim 1, wherein the printhead comprises an ink-jet printhead which discharges ink to print information.

9. The apparatus according to claim 8, wherein the printhead discharges ink by using heat energy, and comprises a heat energy converter for generating the heat energy to be applied to ink.

10. The apparatus according to claim 1, wherein the first print circuit board and the second print circuit board are connected by using three wiring conductors, a power supply line for supplying power, a GND line for supplying a main load current and a GND line for detecting a voltage datum.

11. The apparatus according to claim 10, wherein one of the GND lines is connected to a constant-voltage control circuit of the voltage conversion means.

* * * * *

UNITED STATES PATENT AND TRADEMARK OFFICE

CERTIFICATE OF CORRECTION

PATENT NO. : 6,796,626 B2
DATED : September 28, 2004
INVENTOR(S) : Hideyuki Nishida It is certified that error appears in the above-identified patent and that said Letters Patent is hereby corrected as shown below:

Column 2,
Line 1, "$V_{Drop}$)" should read -- ($V_{Drop}$) --.
Line 3, "$V_{Drop}$)," should read -- ($V_{Drop}$), --.

Column 3,
Line 6, "$I_{Prhd}$)" should read -- ($I_{Prhd}$) --.

Column 11,
Line 25, "correspondence-" should read -- correspondence --.

Signed and Sealed this

Fifth Day of July, 2005

JON W. DUDAS
*Director of the United States Patent and Trademark Office*